US005305668A

United States Patent [19]

Davis

[11] Patent Number: 5,305,668

[45] Date of Patent: Apr. 26, 1994

[54] ARTICULATED WRENCH APPARATUS

[76] Inventor: Clive N. Davis, 218 Barnum Ave., Port Jefferson, N.Y. 11777

[21] Appl. No.: 55,286

[22] Filed: May 3, 1993

[51] Int. Cl.[5] ..... B25B 23/16

[52] U.S. Cl. ..... 81/177.7; 81/177.6

[58] Field of Search ..... 81/177.1, 177.2, 177.6, 81/177.7, 177.8

[56] References Cited

U.S. PATENT DOCUMENTS 1,431,389 10/1922 Frisz ..... 81/177.7

1,903,660 4/1933 Smith et al. ..... 81/177.6 X 2,282,148 5/1942 Mandl ..... 81/177.2 X 2,520,652 8/1950 Pfauser et al. ..... 81/177.2 X

*Primary Examiner*—James G. Smith

*Attorney, Agent, or Firm*—Leon Gilden

[57] ABSTRACT

An articulated wrench structure includes a plurality of link members pivotally mounted relative to one another, with a forwardmost link member of said link members having a wrench head mounted thereto, with a rearwardmost link member including a handle and socket cavities mounted thereto.

2 Claims, 5 Drawing Sheets

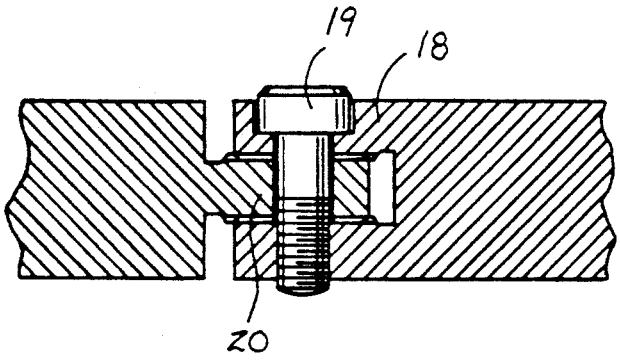
FIG. 3
FIG. 4
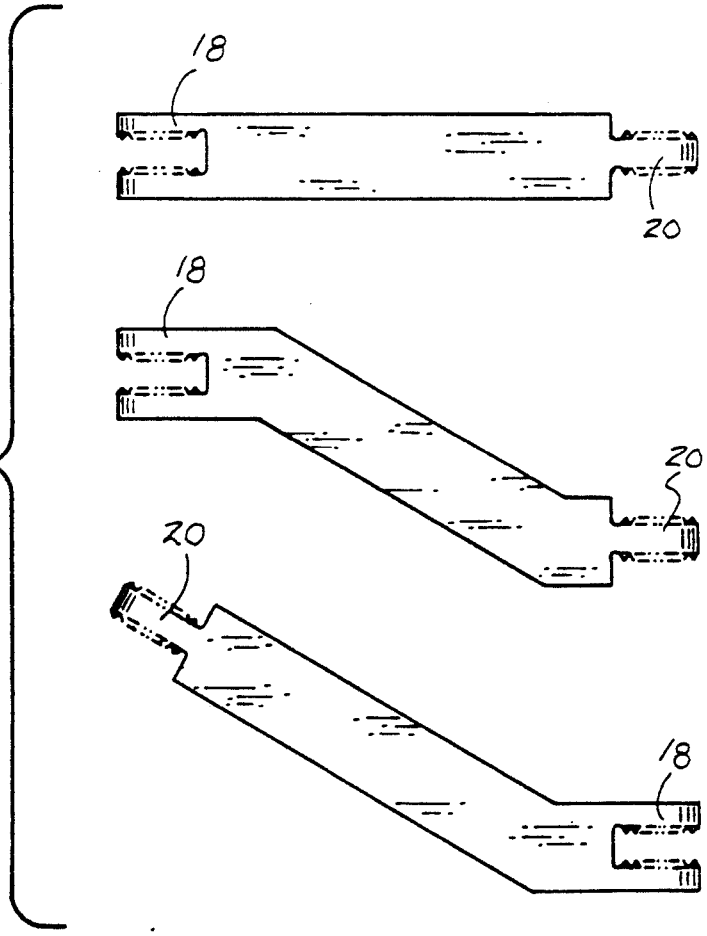

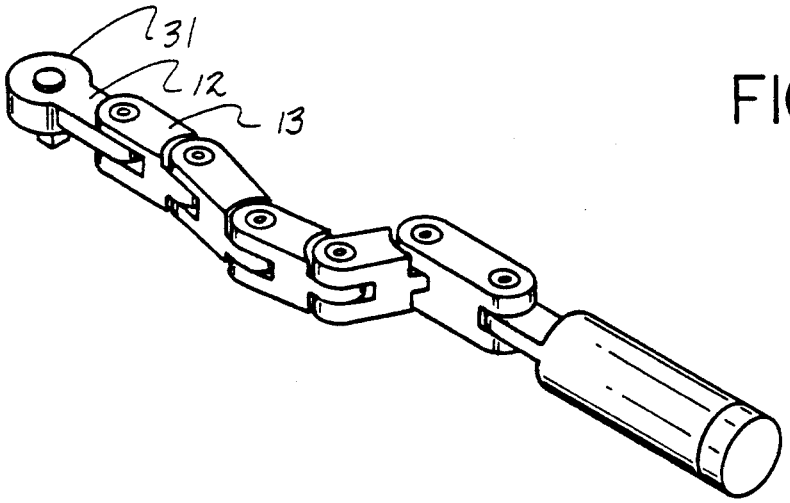
FIG. 7
FIG. 8
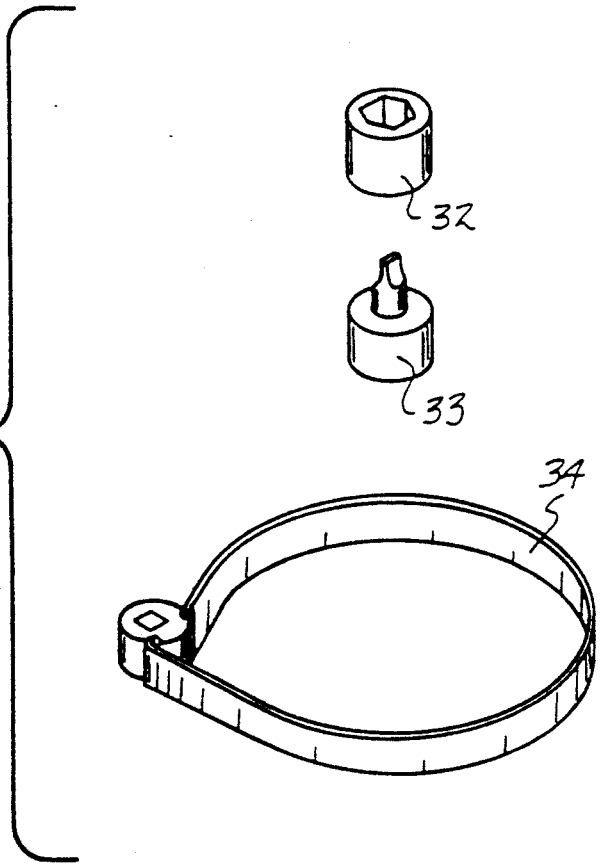

ARTICULATED WRENCH APPARATUS

BACKGROUND OF THE INVENTION

1. Field of the Invention

The field of invention relates to wrench apparatus, and more particularly pertains to a new and improved articulated wrench apparatus wherein the same employs an elongate articulated wrench body having pivotally mounted links relative to one another.

2. Description of the Prior Art

Wrench structure of various types are utilized throughout the prior art such as exemplified in the U.S. Pat. Nos. 4,311,070; 4,787,275; 4,819,521; and 4,158,975.

The instant invention attempts to overcome deficiencies of the prior art by employing a wrench body having a series of articulated and pivotally mounted links arranged for pivoting relative to one another to provide access to remote and difficult to be attained regions within a work environment and in this respect, the present invention substantially fulfills this need.

SUMMARY OF THE INVENTION

In view of the foregoing disadvantages inherent in the known types of wrench apparatus now present in the prior art, the present invention provides an articulated wrench apparatus wherein the same is directed to a wrench body having a plurality of link members pivotally mounted relative to one another. As such, the general purpose of the present invention, which will be described subsequently in greater detail, is to provide a new and improved articulated wrench apparatus which has all the advantages of the prior art wrench apparatus and none of the disadvantages.

To attain this, the present invention provides an articulated wrench structure including a plurality of link members pivotally mounted relative to one another, with a forwardmost link member of said link members having a wrench head mounted thereto, with a rearwardmost link member including a handle and socket cavities mounting thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved articulated wrench apparatus which has all the advantages of the prior art wrench apparatus and none of the disadvantages.

It is another object of the present invention to provide a new and improved articulated wrench apparatus which may be easily and efficiently manufactured and marketed.

It is a further object of the present invention to provide a new and improved articulate wrench apparatus which is of a durable and reliable construction.

An even further object of the present invention is to provide a new and improved articulated wrench apparatus which is susceptible of a low cost of manufacture with regard to both materials and labor, and which accordingly is then susceptible of low prices of sale to the consuming public, thereby making such articulated wrench apparatus economically available to the buying public.

Still yet another object of the present invention is to provide a new and improved articulated wrench apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an orthographic view of a plurality of available link members arranged for use within the organization.

FIG. 7 is an isometric illustration of the invention employing a ratchet head.

FIG. 8 is an isometric illustration of various tool members arranged for use by the invention.

DESCRIPTION OF THE PREFERRED EMBODIMENT

Figure 1:
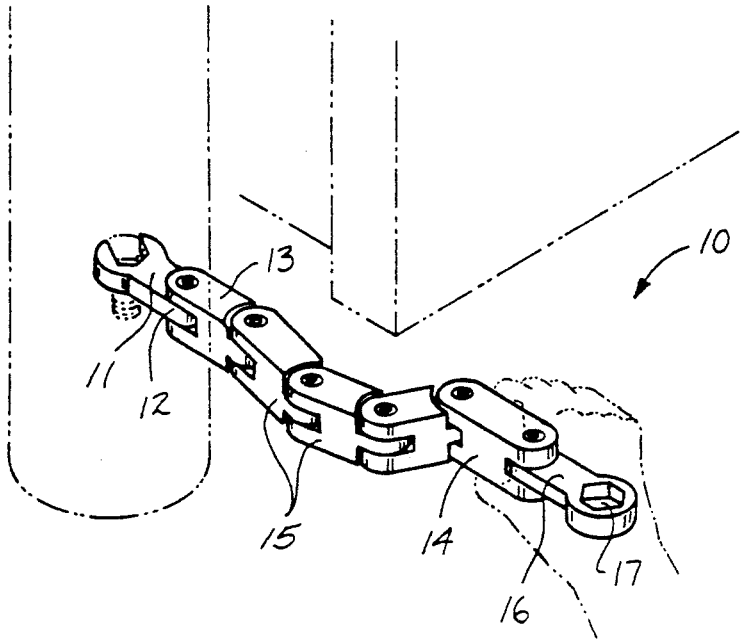
FIG. 1 is an isometric illustration of the invention.

With reference now to the drawings, and in particular to FIGS. 1 to 10 thereof, a new and improved articulated wrench apparatus embodying the principles and concepts of the present invention and generally designated by the reference numeral 10 will be described.

Figure 2:
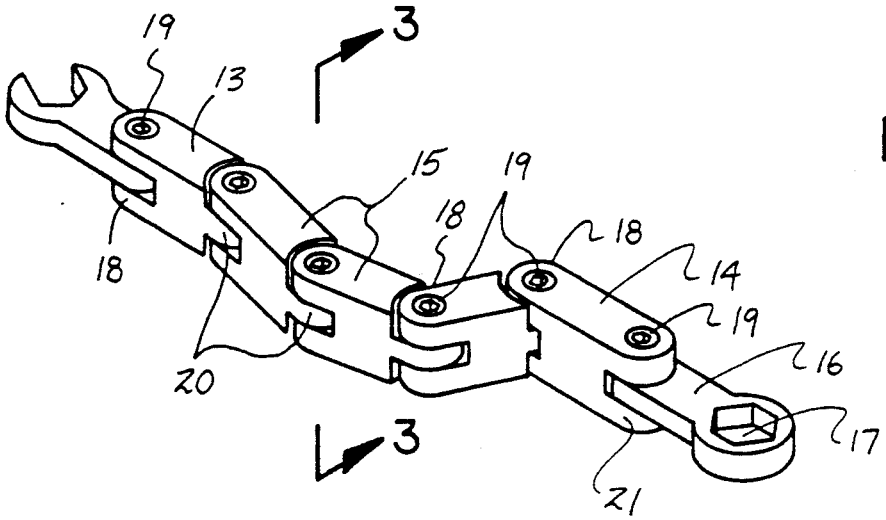
FIG. 2 is an enlarged isometric illustration of the invention.
Figure 5:
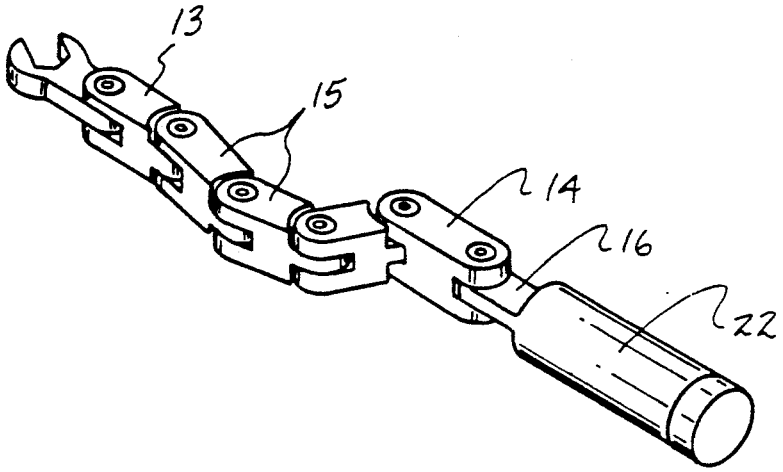
FIG. 5 is an isometric illustration of the invention employing a handle structure.
Figure 6:
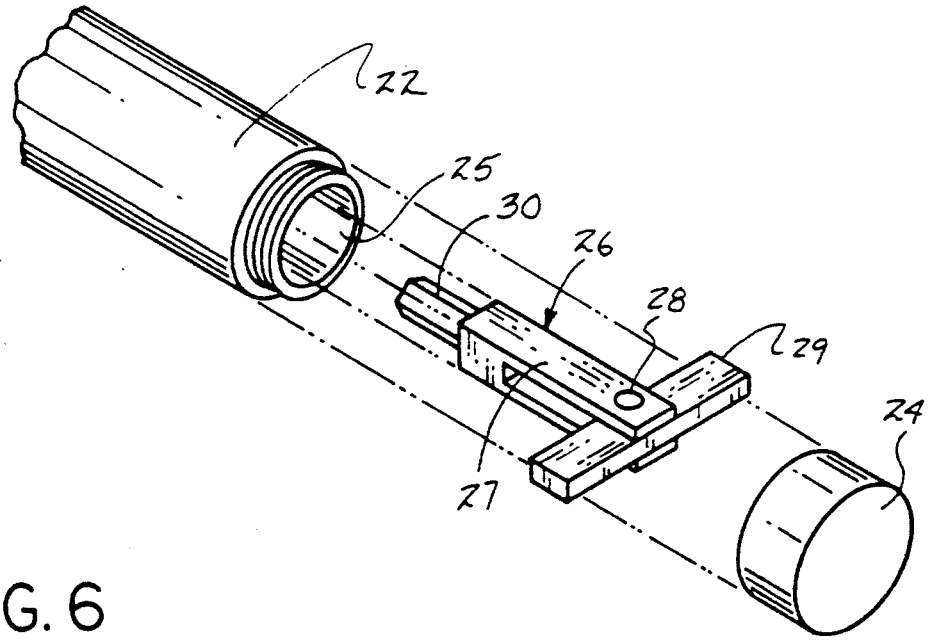
FIG. 6 is an isometric exploded view of the handle structure arranged to receive a torque application tool therewithin.

More specifically, the articulated wrench apparatus 10 of the instant invention essentially comprises a wrench head 11, including a wrench plate 12 pivotally mounting the wrench head 11 to a forward link 13. The forward link 13 is pivotally mounted to intermediate links 15, that in turn are mounted to a rear link 14, that includes a handle plate 16 mounted to the rear link 14. As illustrated in FIGS. 1 and 2, the handle plate 16 is provided with a torque receiving opening 17 orthogonally directed through the handle plate 16 for receiving a torque directing tool therewithin.

The forward link 13, as well as the rear and intermediate links 14 and 15 respectively, each include a bifurcated forward link end 18 receiving a threaded fastener 19 orthogonally therethrough, wherein the forward link 13 directs the fastener 19 through the bifurcated forward link end 18, as well as through the wrench plate 12. The forward link and the intermediate links each include a link rear plate 20 that is received within a forward link end of the intermediate links 15, as well as the rear link 14. The rear link 14, in contrast to the forward and rear links 13 and 14, includes a rear link bifurcated rear link end 21 that receives the handle plate 16 pivotally therewithin secured thereto by means of the fastener structure 19.

The FIG. 4 indicates the use of various intermediate link structure such as a linearly aligned intermediate body, as illustrated in FIG. 4, as well as offset bifurcated forward link end 18 relative to the rear link plate 20.

A handle tube 22 is provided and arranged relative to the wrench plate structure 14. The handle tube 22 includes an end cap 24 providing access to handle cavity 25 to secure a torque tool 26 therewithin for use. The torque tool includes a torque tool body 27 having a body axle 28 pivotally mounting a torque tool handle 29 relative to the body 27 about the axle 28 permitting pivoted alignment of the torque tool handle 29 relative to the torque tool body 27 for reception within the cavity 25. Further, the torque tool head shaft 30 is arranged for application of torque thereto through the handle structure 29.

The FIG. 7 indicates the use of a ratchet head 31 arranged for mounting to the forwardmost link 13 for utilization of various accessory tools such a socket 32, a screwdriver drive 33, and a torque application band 34, as illustrated in FIG. 8.

Figure 9:
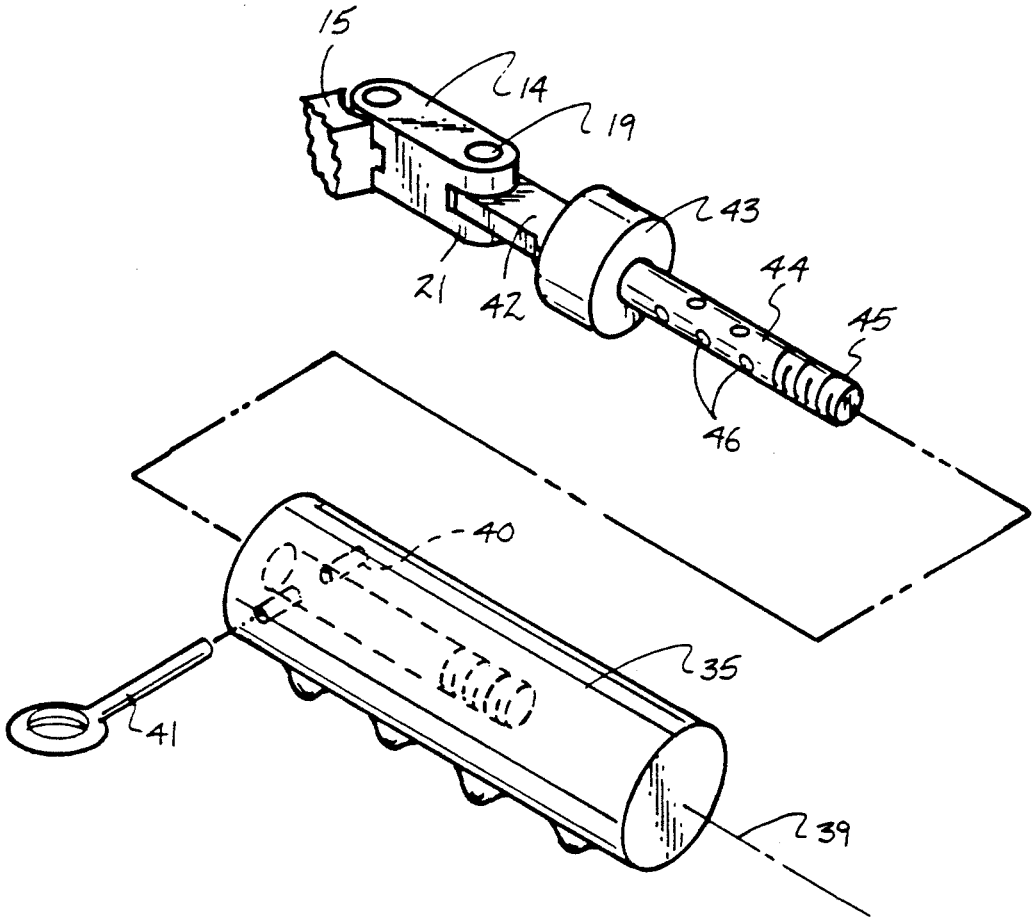
FIG. 9 is an isometric view of a modified handle structure for use by the invention.
Figure 10:
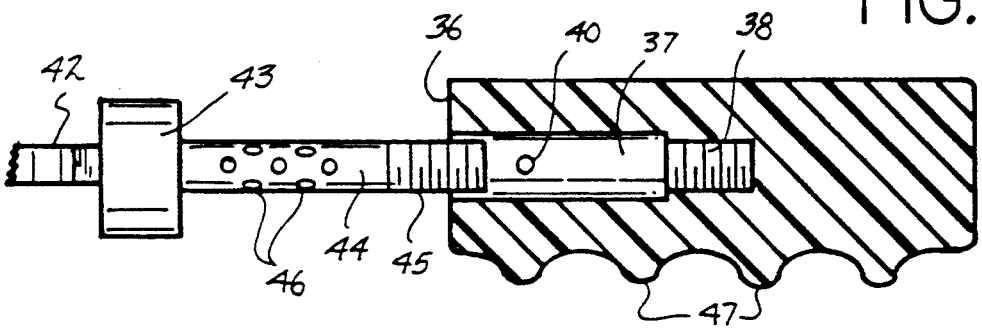
FIG. 10 is an orthographic cross-sectional illustration of the modified wrench handle structure, as indicated in FIG. 9.

The FIG. 9 indicates the use of a modified handle shaft 35 secured to the rear link 14 by the modified handle plate 42, wherein an abutment boss 43 is mounted at an interface between the handle plate 42 and a connecting shaft 44. A matrix of diametrically directed lock bores 46 are directed through the connecting shaft 44 intermediate the abutment boss 43 and a threaded first end of the connecting shaft 44, with the abutment boss 43 indicated as mounted to a second end of the connecting shaft 44 for abutment with a handle shaft forward wall 36. The handle shaft forward wall 36 includes a first bore directed into the forward wall 36, with the first bore 37 coaxially aligned along a handle axis 39 that in turn coaxially receives the connecting shaft 44 therewithin, wherein a second bore 38 coaxially aligned and in communication with the first bore 37 is internally threaded to threadedly receive the connecting shaft threaded first end 45. The connecting shaft 44 may be rotated within the second bore 38 permitting various rotative alignment of the handle shaft 35 relative to the handle plate 42. A pin receiving aperture 40 orthogonally oriented relative to the axis 39 receives a lock pin 41 through the pin receiving apertures 40 positioned on opposed sides and diametrically oriented relative to the handle shaft 35, with the lock pin 41 directed through one of the lock bores 46. In this manner, the finger grip surface 47 projecting from the exterior surface of the handle shaft 35 may be rotated for ease of grasping of the structure, as well as providing for longitudinal adjustment of the handle shaft along the connecting shaft 44 providing greater mechanical advantage through various positions of the handle shaft 35 along the connecting shaft 44.

It should be noted that various tool heads, in lieu of the wrench head 11, the ratchet head 31 and the like may be mounted to the forward link 13 relative to various mechanical needs in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An articulated wrench apparatus, comprising a forward link and a plurality of intermediate links pivotally mounted relative to one another, with the forward link mounted to one of said intermediate links, and a rear link mounted to one of said intermediate links spaced from the forward link, with the forward link including a tool head pivotally mounted to the forward link, and the rear link including a handle plate pivotally mounted to the rear link, and the forward link includes a bifurcated forward link end pivotally receiving the tool head therewithin and the forward link including a link rear plate, with each of the intermediate links including an intermediate link bifurcated forward end, and the rear link including a bifurcated rear end pivotally mounting the handle plate therewithin, and the handle plate includes an abutment boss, and a connecting shaft fixedly and orthogonally mounted to the abutment boss at a second end of the connecting shaft, with a first end of the connecting shaft having a threaded portion, and a handle shaft, the handle shaft having a handle shaft forward end, with the handle shaft forward end including a first bore directed through the handle shaft forward end, and a second bore in communication with the first bore, with the second bore internally threaded to receive the handle shaft second end threadedly therewithin.

2. An apparatus as set forth in claim 1 wherein the connecting shaft includes a plurality of lock bores directed through the connecting shaft intermediate the connecting shaft first end and the connecting shaft second end, and the first bore having a plurality of coaxially aligned pin receiving apertures intersecting the first bore, with the pin receiving apertures directed through the handle shaft, with the handle shaft symmetrically oriented about a handle axis, and the pin receiving apertures orthogonally oriented relative to the handle axis, and a lock pin, with the lock pin arranged for reception throught the pin receiving apertures and one of said lock bores.

* * * * *